US010357986B2

(12) United States Patent
Zhou et al.

(10) Patent No.: US 10,357,986 B2
(45) Date of Patent: Jul. 23, 2019

(54) FABRIC PRINT MEDIA

(75) Inventors: Xiaoqi Zhou, San Diego, CA (US); Christine E. Steichen, Escondido, CA (US); Luis Garcia Garcia, Barcelona (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 616 days.

(21) Appl. No.: 14/406,340

(22) PCT Filed: Jul. 18, 2012

(86) PCT No.: PCT/US2012/047154

§ 371 (c)(1),
(2), (4) Date: Dec. 8, 2014

(87) PCT Pub. No.: WO2014/014453

PCT Pub. Date: Jan. 23, 2014

(65) Prior Publication Data

US 2015/0132508 A1 May 14, 2015

(51) Int. Cl.

| | |
|---|---|
| ***B41M 5/50*** | (2006.01) |
| ***B05D 7/00*** | (2006.01) |
| ***B05D 3/00*** | (2006.01) |
| ***B41M 5/52*** | (2006.01) |
| ***D06P 5/30*** | (2006.01) |
| ***D06P 5/00*** | (2006.01) |

(52) U.S. Cl.

CPC ..... *B41M 5/508* (2013.01); *B05D 3/00* (2013.01); *B05D 7/56* (2013.01); *B05D 7/58* (2013.01); *B05D 7/584* (2013.01); *B41M 5/52* (2013.01); *B41M 5/5218* (2013.01); *D06P 5/002* (2013.01); *D06P 5/30* (2013.01); *B41M 5/502* (2013.01); *B41M 5/506* (2013.01); *B41M 5/529* (2013.01); *B41M 5/5227* (2013.01); *B41M 5/5245* (2013.01); *B41M 5/5254* (2013.01); *B41M 2205/34* (2013.01); *B41M 2205/42* (2013.01)

(58) Field of Classification Search

CPC .... B41M 5/506; B41M 5/508; B41M 5/5218; B41M 5/5227; B41M 5/5245; B05D 3/00; B05D 7/56; B05D 7/584

See application file for complete search history.

(56) References Cited

U.S. PATENT DOCUMENTS 5,707,951 A * 1/1998 Masschelein ..... C11D 3/38645 510/320
6,096,469 A * 8/2000 Anderson ..... B41M 5/52 423/335
6,589,633 B1 7/2003 Ino et al.
6,811,837 B2 11/2004 Iwasa et al.
2002/0025379 A1* 2/2002 Nakamura ..... D06P 5/30 427/322
2002/0037395 A1 3/2002 Zhong et al.
2002/0041317 A1* 4/2002 Kashiwazaki ..... C09D 11/324 347/100
2002/0164462 A1* 11/2002 Kohsaka ..... B41M 5/506 428/32.16
2002/0192434 A1 12/2002 Yuan et al.
2003/0050379 A1 3/2003 Shih et al.
2003/0186003 A1* 10/2003 Nakano ..... B41M 5/52 428/32.1
2005/0030363 A1* 2/2005 De Vries ..... B41M 5/506 347/106
2006/0010619 A1 1/2006 Hees et al.
2006/0204685 A1* 9/2006 Missell ..... B41M 5/52 428/32.34
2007/0231509 A1 10/2007 Xu et al.
2008/0092309 A1 4/2008 Ellis et al.
2009/0136692 A1* 5/2009 Takahashi ..... B41M 5/5218 428/32.25
2010/0040790 A1* 2/2010 Elizalde ..... C09D 5/1687 427/385.5
2010/0120309 A1 5/2010 Arnold et al.

(Continued)

FOREIGN PATENT DOCUMENTS

CN 1537142 10/2004
EP 0779162 A2 6/1997

(Continued)

OTHER PUBLICATIONS

European Patent Office, European Patent Application No. 12881154.4, Extended European Search Report dated Nov. 10, 2015, 5 pages.

(Continued)

*Primary Examiner* — Betelhem Shewareged

(74) *Attorney, Agent, or Firm* — Thorpe North & Western LLP

(57) ABSTRACT

The present disclosure is drawn to fabric print media and a method of coating a fabric substrate to form a fabric print medium. The fabric print medium can comprise a primer layer applied to the fabric substrate, an ink-fixing layer applied to the primer layer, and an ink-receiving layer applied to the ink-fixing layer. The primer layer can include a first film-forming polymer and a fabric softening agent. The ink-fixing layer can comprise a second film-forming polymer and a cationic compound. The ink-receiving layer can comprise a third film-forming polymer and non-deformable particles. One or more of the primer layer, the ink-fixing layer, and the ink-receiving layer also further comprise a flame inhibitor. In one example, all of these three layers include the flame inhibitor.

20 Claims, No Drawings

(56) References Cited

U.S. PATENT DOCUMENTS

| | | | | |
|---|---|---|---|---|
| 2011/0169901 | A1 | 7/2011 | Pinto et al. | |
| 2015/0132508 | A1* | 5/2015 | Zhou | B41M 5/508 428/32.16 |

FOREIGN PATENT DOCUMENTS

| | | | |
|---|---|---|---|
| EP | 1582370 | | 10/2005 |
| JP | 2000-303361 | A | 10/2000 |
| JP | 2002-339242 | A | 11/2002 |
| JP | 2002321452 | | 11/2002 |
| WO | WO-2005/035865 | A2 | 4/2005 |

OTHER PUBLICATIONS

International Search Report and Written Opinion dated Mar. 27, 2013 for International Application No. PCT/US2012/047154 filed Jul. 18, 2012, Applicant Hewlett-Packard Development Company, L.P. et al.

* cited by examiner

FABRIC PRINT MEDIA

BACKGROUND

Different forms of printing, such as inkjet printing, have found various applications on different substrates including traditional cellulose paper, metal, plastic, fabric, and the like. Regarding fabric specifically, challenges related to various printing technologies exist because of the nature of fabric. Some fabrics, for example, can be highly absorptive, diminishing color characteristics, while some synthetic fabrics can be crystalline, decreasing aqueous ink absorption leading to ink bleed. These characteristics result in the image quality on fabric being relatively low. Additionally, optical density, color gamut, and image sharpness are often poor compared to images printed on cellulose paper or other media types. As the moisture sensitivity of images printed on fabric is usually high, images are formed that have poor waterfastness and washability. Further, when fabric is intended to be used in close proximity to indoor environments, as drapes, as overhead signage, as part of furnishings, or the like, there are also concerns about flame resistance as well as about using image receiving coatings that increase the flammability of the fabric. Thus, fire or flame resistant or inhibition characteristics can also be desirable when providing printable fabrics. Durability, such as rubbing resistance, is another concern when printing on fabric, particularly when using pigmented inks. Latex inkjet printing generally provides acceptable results when the printing surface is smooth so that the latex can form a continuous film that bonds the ink pigments together. However, fabric substrates are generally rough. Thick coatings can be used to provide acceptable surface smoothness; however, thick coatings also alter the soft feeling of the fabric, which can be undesirable for consumers.

Obtaining good print characteristics while retaining fabric softness, water resistance, and flame inhibiting characteristics can be challenging, and providing one or more of these features would be an advancement in the art of printable fabric.

DETAILED DESCRIPTION

In accordance with this, compositions and associated methods described herein are directed generally towards coated fabric substrates for printing. Often, fabric does not accurately receive inkjet inks due to bleed, diminished color characteristics, etc., particularly over a wide variety of inks. Additionally, as the moisture sensitivity of fabric leads to poor waterfastness, washability characteristics, fabric softness, etc., by coating fabrics with a multi-layered coating process as described herein, it has been discovered that printing on fabric can be accurate and more permanent, and the resultant fabric can remain soft while providing fire or flame resistant or inhibition properties to the fabric.

In accordance with this, application of multiple layers with certain functionality may be used to improve the print quality and optical density of the image, improve print durability, provide flame inhibition, and maintain the flexible and soft hand feeling of the fabric substrate. Generally, various layers including film-forming polymers, fabric softening agents, cationic compounds, non-deformable particles, and flame inhibitors can be prepared to accomplish these or other printing goals. For example, the cationic compounds can be used to fix the ink, providing acceptable print edge acuity and ink fixation. The use of non-deformable particles in an outermost layer can provide space for ink to be accepted and allowed to pass through to the coating layers positioned therebeneath, protecting the ink from damage within the interparticulate space. Other combinations of benefits can also be achieved by the various layers described herein, depending on the specific components selected for use in combination with one another.

More specifically, the present disclosure is drawn toward a fabric print medium comprising a fabric substrate, a primer layer applied to the fabric substrate, an ink-fixing layer applied to the primer layer, and an ink-receiving layer applied to the ink-fixing layer. The primer layer can comprise a first film-forming polymer and a fabric softening agent. The ink-fixing layer can comprise a second film-forming polymer and a cationic compound. The ink-receiving layer can comprise a third film-forming polymer and non-deformable particles. It is also noted that one or more of the primer layer, the ink-fixing layer, and the ink-receiving layer further comprises a flame inhibitor, and in some examples, two or all three of these layers can comprise a flame inhibitor. When the flame inhibitor is present in multiple layers, the compound can be the same in each layer, or can be independently selected specifically for each layer, e.g. one can be different from the other or all three can be different. Likewise, the first, second, and third film-forming polymer can be the same, or can be independently selected for each layer. For example, a flame inhibiting film-forming polymer can be used in the ink-receiving layer, whereas, the same polymer may not necessarily selected for use in the primer layer or the ink-fixing layer.

In another example, a method of coating a fabric substrate to form a fabric media substrate can comprise impregnating or padding a fabric substrate with a primer coating composition to form a primer layer. The primer coating composition can include a film-forming polymer and a fabric softening agent. Additional steps include applying an ink-fixing layer coating composition onto the primer layer form an ink-fixing layer, and applying an ink-receiving layer coating composition onto the ink-fixing layer to form an outermost ink-receiving layer. The ink-fixing layer coating composition can include a cationic compound, such as a cationic metal complex or a cationic polymer. The ink-receiving layer coating composition can include non-deformable particles. In this example, one or more of the primer layer coating composition, the ink-fixing layer coating composition, and the ink-receiving layer coating composition further comprises a flame inhibitor. Optional steps include calendaring the primer layer, the ink-fixing layer, or the ink-receiving layer, or any combination of these layers. Further, in one example, drying of the primer layer can be carried out under heat at temperature greater than 120° C. Optionally, the primer layer can also undergo thermalsetting at a higher temperature, e.g., about 200-210° C. for 30-60 seconds. Drying of the ink-fixing layer and/or the ink-receiving layer can be carried out under heat at a temperature less than 100° C. The method can also comprise coating both a front side and a back side of the fabric substrate with the primer layer, the ink-fixing layer, and ink-receiving layer.

It is noted that when discussing the present fabric print media and methods, each of these discussions can be considered applicable to each of these embodiments, whether or not they are explicitly discussed in the context of that embodiment. Thus, for example, in discussing fabric print media, such as discussion is also relevant to the method of preparing the fabric print medium, and vice versa. Further, it is noted that the multi-layered coatings/layers described herein can be understood to comprise structures with significant interface between the respective layers. Thus, in some examples, there may actually be no substantially distinct layers after processing, as the layers form a composite that becomes merged together to form an unevenly distributed structure along a Z-axis of the coating layer(s) defined by the coating thickness.

Turning now to the individual components of the fabric print medium and related methods of the present disclosure, detailed discussion of the film-forming polymer, the fabric softening agent, the cationic compound, the non-deformable particulates, the flame inhibitor, and other optional ingredients are provide below. Furthermore, specific discussion of the fabric substrate is also provided as it relates to the fabric media substrate and related methods.

Regarding the fabric substrate, any textile, fabric material, fabric clothing, or other fabric product where there is a desire for application of printed matter can benefit from the principles described herein. More specifically, fabric substrates useful in present disclosure include substrates that have fibers that may be natural and/or synthetic. Examples of fabrics with natural fibers include those with fibers of wool, cotton, silk, linen, jute, flax, hemp, rayon, and/or thermoplastic aliphatic polymers derived from renewable resources such as corn starch, tapioca products, or sugarcanes like poly(lactic acid) or polylactide (PLA). Examples of fabrics with synthetic fibers include those with fibers of polyesters, polyamides, polyimides, polyacrylic, polypropelene, polyethylene, polyurethane, polystyrene, polyaramid (such as Kevlar®), polytetrafluoroethylene (TEFLON®), fiberglass, polytrimethylene, polycarbonates, polyester terephthalate, or polybutylene terephthalate. Mixtures and combinations of such natural and/or synthetic fibers can be also used. The fibers may also comprise special additives such as colorant (e.g., pigments, dyes, tints, and the like), antistatic agents, brightening agents, nucleating agents, antioxidants, UV stabilizers, fillers, lubricants, and the like. Any construction of these natural or synthetic fibers can also be used as the fabric substrate, such as materials constructed that are woven, knitted, non-woven, tufted, or the like. Woven textiles can include, but are not limited to, satin, poplin, and crepe weave textiles. Knitted textiles can include, but are not limited to, circular knit, warp knit, and warp knit with a microdenier face. Furthermore, the fabric substrates of the present disclosure can be flat, or may exhibit a pile.

It is notable that the term "fabric substrate" does not include materials commonly known as paper, even though paper can include fibers. Furthermore, fabric substrates include both textiles in its filament form, in the form of fabric material, or even in the form of fabric that has been crafted into finished article (clothing, blankets, tablecloths, napkins, bedding material, curtains, carpet, shoes, etc.). In other words, surface modification coatings of the present disclosure can be prepared and applied to the fabric substrates of the present disclosure in any manner that enables application of the coating composition to the fabric substrate. Such application can be to finished textiles or fabric, or can be applied to textile fibers prior to preparation of the fabric from threads or filaments.

Turning specifically to the coating compositions and resultant coating layers that are formed therefrom, it is noted that a flame inhibitor can be included in one, two, or all three of the layers described herein. Thus, a general discussion of the flame inhibitor is applicable to any of the primer layer, the ink-fixing layer, the ink-receiving layer, related coating compositions and methods, or the like. In accordance with this, flame inhibitors that provide added fire or flame resistance or flame or fire inhibiting properties can be used. Example of such flame inhibitors include organ halogenated compounds, such as organobromines and organochlorines, e.g., decabromodiphenyl ether, decabromodiphenyl ethane, polymeric brominated compounds such as brominated polystyrenes, brominated carbonate oligomers, brominated epoxy oligomers, tetrabromophthalic anyhydride, tetrabromobisphenol A, hexabromocyclododecane, ethers of chlorendic acid and chlorinated paraffins, etc.

Non-halogenated compounds can likewise be used and can often be considered to be more environmentally friendly. Examples include phosphorus-containing compounds and nitrogen-containing compounds. Phosphorus-containing compounds including organic and inorganic phosphates, phosphonates, and/or phoshpinates with different oxidation states are effective for use. Nitrogen-containing compounds that can likewise be used include melamines (including melamine derivatives) such as melamine, melamine cyanurate, melamine polyphosphate, melem, and melon. The organohalogenated compounds, phosphorus-containing compounds, or nitrogen-containing compounds can be used individually or in combination one other, or can include compounds that comprise any combination of a halogen, phosphorus, and nitrogen. In some examples, an organophosphate can be used and can be selected from aliphatic phosphates and phosphonates, and aromatic phosphonates. For these examples, organophosphate can be an organophosphonate with four oxygen atoms attached to the central phosphorus; an aliphatic, aromatic, or polymeric organophosphate with 3 oxygen atoms attached to the central phosphorus, or an organophosphinate with 2 oxygen atoms attached to the central phosphorus atom. Formula I below provides a general formula for an organophosphonate, Formula II sets forth an organophosphate that can be aliphatic organophosphate, an aromatic organophosphate, or an organophosphate polymer; and Formula III provides a formulaic example of organophosphinates. Thus, the organophosphates used in accordance with examples of the present disclosure can have general Formula I-III, as follows:

Formula I

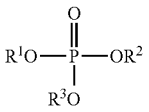

Formula II

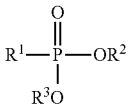

Formula III

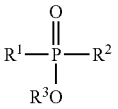

where $R^1$, $R^2$, and $R^3$ are individually organic or inorganic substituents that can be different or the same, including $C_1$-$C_{12}$ branched or straight chained alkyl, aryl, bisphosphate, or halogen (such as chlorinated or fluorinated substituents). Other specific examples of organophosphates include tris (1,3-dichloroisopropyl) phosphate, tris (2-chloroisopropyl) phosphate, tris (2-chloroisopropyl)phosphate, dimethyl phosphonate, diethyl phosphonate, dimethyl propyl phosphonate, diethyl N,N-bis(2-hydroxyethyl)aminomethyl phosphonate, oligomeric chloroalkyl phosphates, chloroalkyl phosphates, aryl phosphates, or the like.

Compounds having a molecular structure that includes both nitrogen and phosphorus also show acceptable properties. Examples of such compounds include APP (ammonium polyphosphate), PDSPB (poly (4,4-diaminodiphenyl methane spirocyclic pentaerythritol bisphosphonate)), DTPAB (1,4-di(diethoxy thiophosphamide benzene), and mixtures thereof.

In another example, a flame inhibitor can be used that is selected from water soluble phosphorus-containing compounds, which can sometimes provide for simpler processing, for example, better water solubility, during manufacture. One example phosphorus-containing compound acceptable for use is a phosphonate ester with one or two phosphorus-containing closed 4-to 6-membered ring structure. An example of such a compound is 5-ethyl-2-methyl-1,3,2-dioxaphosphorinan-5-yl)methyl dimethyl phosphonate P-oxide, having the following structure:

Formula IV

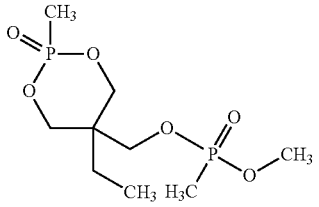

Another example, is bis[(5-ethyl-2-methyl-1,3,2-dioxaphosphorinan-5-yl)methyl]methyl phosphonate P,P'-dioxide, having the following structure:

Formula V

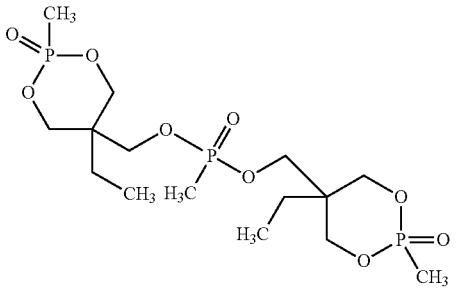

Other phosphonate esters with a phosphorus-containing closed ring structure can be selected from some commercial available products, such as FR-102® from Shanghai Xusen Co Ltd, China and AFLAMMIT® from Thor, Germany.

The flame inhibitor can be present, by solids, in the primer layer at a weight ratio of flame inhibitor to film-forming polymer from 99:1 to 70:30. The flame inhibitor can be present, by solids, in the ink-fixing layer at from 5 wt % to 50 wt %, or from 10 wt % to 40 wt %, though these ranges are only exemplary and are not intended to be limiting. Furthermore, the flame inhibitor can be present, by solids, in the ink-receiving layer at from 5 wt % to 50 wt %, or from 10 wt % to 40 wt %, though these ranges are only exemplary and are not intended to be limiting. It is also notable that all these flame inhibitors can be used alone or in combination with one another, or further, in combination with phosphor containing esters to provide desired coating characteristics such as viscosity or improved characteristics of the finished product, including enhanced flame resistance, flexibility, and/or softness of the fabric substrate.

Turning now to a more specific discussion of the primer layer coating compositions and primer layers prepared therefrom, such compositions can comprise liquid carrier (water, organic solvent, and/or other liquid additives), a film-forming polymer, and a fabric softening agent. The film-forming polymer can include compounds which can form a continuous film and can have strong binding power to the fabric substrate, such as natural or synthetic macromolecule compounds. In one example, polyurethane compounds can be used, and in other examples, modified polyacrylate compounds can be used, e.g., modified polyacrylates include copolymers of acrylic with methacrylic, acrylic acid, styrene, and anhydride. Yet in other examples, the synthetic polymers such as polyvinyl alcohol and polyvinyl acetate can be used. Further, in another example, nature polymers such as starches and chemically modified starches can be used. These film-forming polymers can be formed by polymerization of organic monomers, inorganic monomers, and hybrids of organic and inorganic monomers. In one example, an organic polymer such as polyurethane or polyacrylate can be grafted with some inorganic unites such as halogen groups, e.g., bromides, fluorides, and chlorides, phosphorus groups, and/or nitrogen groups.

When selecting a film-forming polymer, low glass transition temperature and high surface energy can be desirable, e.g., Tg ranging from −40° C. to 20° C. and surface energy in the form of a film ranging from 35-50 dyne/cm. This relatively low Tg provides a flexible polymer chain and provides that the polymer will not adversely impact the softness of fabric materials, while these higher surface energies provide acceptable adhesive bonding strength. That being stated, the film-forming polymers can be cationic, anionic, or neutral in charge when presented in aqueous or other solution in preparation for application to the fabric substrate as part of a primer layer coating composition. However, in some examples, there are some added benefits to using cationic or neutral compounds, e.g., cationic and neutral film-forming polymers can provide additional fixing properties for inks printed on the media of the present disclosure. However, with most inks, such a benefit would typically not be present when the film-forming polymer is anionically charged.

In further detail, the primer layer coating composition and resultant primer layer prepared therefrom can also comprise a fabric softening agent to improve the hands feel of the fabric. The fabric softening agent can be selected from compounds with cationic characteristics, such as imidazolium, quaternary alkoxy ammonium salts including quaternary ammonium salts with $C_8$ to $C_{35}$ alkyl group side chains. Alternatively, another example of a quaternary salt with multiple long ($C_8$ to $C_{35}$) alkyl side chains is dipalmitoylethyl hydroxyethylmonium methosulfate, shown as follows as Formula VI:

Formula VI

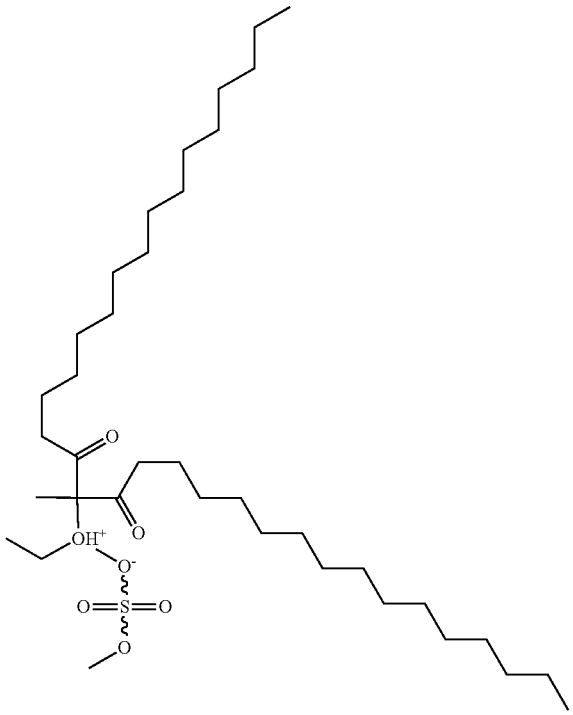

Other fabric softening agents that can be used include organophospheric esters from phosphates, phosphonates, and phoshpinates described previously herein. These types of fabric softening agent can provide the dual function of enhancing fabric softness as well as provide flaming inhibition or resistance to the fabric.

The primer layer coating composition can be applied to the fabric media substrate by soaking and/or padding or any other method known in the art. Suitable coating ranges can be from 0.05 gsm to about 30 gsm. Regarding the ink-fixing layer coating composition and the ink-fixing layer prepared therefrom, typically, this layer is applied directly onto the primer layer. The ink-fixing layer, as mentioned, can optionally include the flame inhibitor as described above. Furthermore, the ink-fixing layer also includes a cationic compound, such as cationic metal complex or a cationic polymer. Regarding the cationic metal complex, a charged complex ion derived from the metal complex with coordinate covalent bonds or dative covalent bonds can be used. The coordination number is defined by the number of ligand(s) attached to the central metal ion, and typically ranges from two to nine, or even more. In some examples, the ligands can be a small polar molecules, such as $H_2O$ and $NH_3$, and in some examples, the ligands can be anions such as $Cl^-$, $OH^-$ and $S^{2-}$. Often, the metal complex or charged complex ion with associated ligands will be white in color or colorless. Typical examples include $[Al(H_2O)_6]^{3+}$, $[Al(H_2O)_3(OH)_3]$, $[Al(H_2O)_3(OH)_3]$, and $[Al(H_2O)_3(OH)_3]$. Another specific example includes potassium aluminum sulfate dodecahydrate. Alternatively, the metal complex can include two or more central atoms, also referred to as polynuclear complexes, which can be formed when a ligand donates electron pairs to two or more metal ions simultaneously and then acts as bridge between the multiple central ions. In some examples, the charged complex ions can be octa-aquo-dioxodialuminim $(iV)^{4+}$, $Al_8(OH)_{20}{}^{4+}$, and $[Al_8(OH)_{10}(SO4)_5]^{4+}$. Other types of multivalent metal salts without similar complex structure as described above may also be used to similar effect. For example, aluminum fluorosulfate and aluminum chloride can also provide acceptable printing characteristics. The inclusion of one of these salts or other similar salt can improve the print quality and optical density of printed areas on fabrics.

In another example, a cationic polymer can be used as the cationic compound. Example of cationic polymers that can be used include poly diallyldimethylammonium chloride, polydiallylamine, polyethylene imine, poly2-vinylpyridine, poly 4-vinylpyridine poly2-(tert-butylamino)ethyl methacrylate, poly 2-aminoethyl methacrylate hydrochloride, poly 4'-diamino-3,3'-dinitrodiphenyl ether, poly N-(3-aminopropyl)methacrylamide hydrochloride, poly 4,3,3'-diaminodiphenyl sulfone, poly 2-(iso-propylamino)ethylstyrene, poly2-(N,N-diethylamino)ethyl methacrylate, poly 2-(diethylamino)ethylstyrene, and 2-(N,N-dimethylamino) ethyl acrylate, to name a few.

The metal complex and/or cationic polymers can be present, by solids, in the ink-fixing layer coating composition or on the fabric substrate at from 5 wt % to 50 wt %, or from 10 wt % to 40 wt %, though these ranges are only exemplary and are not intended to be limiting. In some examples, synthetic polymers can have a higher tendency to promote fire, and thus, the use of a smaller amount of these types of polymers can be advisable in combination with a metal complex or other cationic compound, though this is not required.

Additionally, the ink-fixing layer and related coating compositions can also include a film-forming polymer. A detailed description of film-forming polymers is provided above in the description of the primer layer, and that description is incorporated herein. It is noted, however, that the film-forming polymer in the ink-fixing layer need not be the same film-forming polymer that is in the primer layer, but it should be compatible with cationic compound, e.g., it will not cause precipitation when mixed with the cationic compound.

Turning now to the ink-receiving layer coating composition that is used to apply an ink-receiving layer onto the ink-fixing layer, this layer can include non-deformable particles. More specifically, particles can be selected for use that are non-deformable during manufacturing of the coating composition and storing of the finished fabric media, but can deform or form a film under printing temperature conditions of the printing process. Thus, particles are rigid and can form a porous array, but are also able to coalesce and flow to form a localized film, due at least in part to the rise in temperature during cure processing of printing, provided the temperature of the printing or curing process is above the glass transition temperature (Tg) of the polymer particles.

The non-deformable particles can be reactive polymeric particles or non-reactive polymeric particles. "Reactive polymeric particles" include particles that are capable of cross-linking (either via self-cross-linking, e.g., within a single molecule chain, or among multiple molecule chains, such as in the presence of a cross-linking agent) upon exposure of heat during printing. Under such conditions, the reactive polymeric particles may also coalesce so that the reactive polymer particles flow together to form a film due at least in part to chemical bonding generated in the cross-linking reaction. The cross-linking of the reactive polymer particles can form a continuous, substantially non-porous protective film that is both heat flowed and cross-linked. Thus, in this example, the non-deformable particles can be reactive with a cross-linkable functional group. When this is the case, when there is a rise in temperature during printing or curing processes, the cross-linkable functional group can be activated under the heat and initialize the cross-link reaction. As a result, upon printing, the collapse of the particle and the cross-linking of the cross-linkable functional groups causes the particles coalesce and embed printed ink pigment particles so that they physically interlock with the printed or otherwise deposited ink.

The reactive polymer particles selected are generally not limited, as long as macromolecular chains of the particles are capable of the cross-linking reaction mentioned above. Some specific examples of polymer particles include particles of a polymer having an epoxy functionality on a backbone of the polymer, particles of a polymer having an epoxy functionality on a side chain of the polymer, particles of a polymer having fatty acid groups, particles of a polymer having alkoxy-silane groups, particles of a polymer having acetoacetoxy groups, particles of a polymer having hydroxyl groups, particles of a polymer having amine groups, and particles of a polymer having carboxyl groups.

On the other hand, "non-reactive polymer particles" do not initialize a cross-linking reaction. However, upon exposure to the heat during printing, the non-reactive polymeric particles can coalesce, flowing together to form a film due to the rise in temperature above its glass transition temperature (Tg). The coalescing of the non-reactive polymer particles forms a continuous, substantially non-porous protective film that remains uncrosslinked.

The non-deformable and non-reactive particles can be selected from polymers formed by polymerization and/or copolymerization of hydrophobic addition monomers. Examples of hydrophobic addition monomers include, but are not limited to, $C_1$-$C_{12}$ alkyl acrylate and methacrylate monomers (e.g., methyl acrylate, ethyl acrylate, n-propyl acrylate, isopropyl acrylate, n-butyl acrylate, isobutyl acrylate, sec-butyl acrylate, tert-butyl acrylate, 2-ethylhexyl acrylate, octyl arylate, methyl methacrylate, ethyl methacrylate, n-propyl methacrylate, isopropyl methacrylate, n-butyl methacrylate, isobutyl methacrylate, sec-butyl methacrylate, tert-butyl methacrylate), aromatic monomers (e.g., styrene, phenyl methacrylate, o-tolyl methacrylate, m-tolyl methacrylate, p-tolyl methacrylate, benzyl methacrylate), hydroxyl containing monomers (e.g., hydroxyethylacrylate, hydroxyethylmethacrylate), carboxylic acid containing monomers (e.g., acrylic acid, methacrylic acid), vinyl ester monomers (e.g., vinyl acetate, vinyl propionate, vinylbenzoate, vinylpivalate, vinyl-2-ethylhexanoate, vinylversatate), vinyl benzene monomers, $C_1$-$C_{12}$ alkyl acrylamide and methacrylamide monomers (e.g., t-butyl acrylamide, sec-butyl acrylamide, N,N-dimethylacrylamide), and olefin monomers (e.g., polyethylene, polypropylene, and co-polymers). The non-deformable particles can also be selected from polytetrafluoroethylene (PTFE), silica, silicone, paraffin wax, carnauba wax, montan wax, and combinations.

The ink-receiving layer can also comprise a film-forming polymer. The film-forming polymer can be similar or the same as that described above in reference to the primer layer, but typically, the film-forming polymer in the ink-receiving layer can also have flame resistance properties. Examples of such film-forming polymers suitable for use include water-dispersible and water-soluble polymeric compounds such as polyvinyl alcohol, starch derivatives, gelatin, cellulose derivatives, acrylamide polymers, acrylic polymers or copolymers, vinyl acetate latex, polyesters, vinylidene chloride latex, styrene-butadiene, acrylonitrile-butadiene copolymers, styrene acrylic copolymers, and copolymers and combinations. Thus, these film-forming polymers have the ability to adequately bind the non-deformable particles together, and have the added benefit of being flame inhibiting of themselves. In one example, flame inhibiting film-forming binders that can be used include copolymers of vinylidene chloride with monoethylenically unsaturated carboxylic acid. In another example, copolymers of vinylidene chloride with alkyl acrylate, such as ethyl acrylate and butyl acrylate, can be used. In yet another example, copolymers of vinylidene chloride with styrene and butadiene provide both binding and flame inhibiting properties. In each of these examples, the amount of vinylidene chloride monomer can be maximized (50-70 wt %), while in some examples, keeping the glass transition temperature of the copolymer within the range −10-40° C. In still other examples, flame inhibiting copolymers that can be used include polymeric latexes pre-treated with organohalogenated compounds, such as mixtures of .ammonium bromide diammonium phosphate (e.g., 5:30 parts by weight of treatment mixture with 100 parts by weight of polyacrylic, polyvinyl acetate, styrene-butadiene copolymer, ethylene vinyl acetate copolymer, neoprene, polyisoprene, nitrile rubber polybutadiene, ethylene propylene copolymer, or polyvinyl chloride). In still another example, the flame inhibiting film-forming polymer can be polyurethane latex which is grafted with a phosphorus- or nitrogen-containing side chain.

The ink-receiving layer coating composition can be applied to the ink-fixing layer by soaking or any other method known in the art. Suitable coating ranges can also be from 0.05 gsm to about 20 gsm, though thicknesses outside of this range can also be used.

As latex inks can be used effectively with the fabric media described herein, a latex film-forming agent can optionally be used in the ink-receiving layer. Compounds useful as latex ink film-forming agents are any chemical with suitable water compatibility and temperature volatility that is capable of lowering the elastic modulus of latex ink particulates, providing temporary plasticization to promote polymer chain motion. Representative examples of such materials include citrate or sebacate compounds, ethyoxy alcohols, glycol olegomer and low molecular weight polymers, glycol ether, glycerol acetals, surfactants having a more than 12 carbon backbone (anionic, cationic or non-ionic), and cyclic amide like lactams such as β-lactam, γ-lactam, and δ-lactam, and mixtures thereof. In certain examples, the latex ink film-forming agent can be a cyclic amide like lactam, such as β-lactam, γ-lactam, and δ-lactam, or mixtures thereof. In certain other examples, the latex ink film-forming aid can be a γ-lactam. Representative examples of a γ-lactams include N-methyl-2-pyrrolidone, 5-methyl-2-pyrrolidone, and 2-pyrrolidone.

It is notable that typically, the coating compositions can prepared in a liquid carrier that is used to disperse or solubilize coating composition components, though this is not necessarily required. The liquid carrier can be removed, at least in part, from the final product once the coating is applied to the fabric, or can include compounds that remain as solids when a portion of the carrier is removed, through drying. The carrier typically includes one or more of water, cosolvents, surfactants, viscosity modifying agents, inorganic compounds, pH control agents, deformers, or the like. The primary function of the carrier is to dissolve and/or carry the solids or other components that are to remain on the fabric as a coating, and typically, provide a carrier that will suitably carry all the components in the composition and help them uniformly distribute on the fabric surface or the previous coating surface. There is no specific limitation on selection of the carrier components, as long as the carrier as a whole has the function described above.

In further detail regarding the carrier, components that provide added fire retardancy properties (or at least not adding to the flammability of the fabric) can also be desirable for use. Thus, liquid carrier compositions that do not generate char when exposed to fire, and/or which act to block the transfer of fire to the fabric can be considered as desirable carrier components. To provide one example, inorganic compounds such as sodium silicates can be used as part of the carrier, and remains with the primer layer, ink-fixing layer, or ink-receiving layer after the liquid carrier is dried to form the respective layers. For example, the composition $SiO_2.Na_2O$ can be part of the carrier composition (along with water or other liquid components). In this example, the $Na_2O$ can be present in the carrier at from 5 wt % to 15 wt % (e.g., from 9 wt % to 11 wt %); the $SiO_2$ can be present in the liquid carrier from 20 wt % to 40 wt % (e.g., from 30 wt % to 32 wt %); and the balance can be water. In the primer layer, the ink-fixing layer, or the ink-receiving layer, the liquid carrier can be used to carry the coating composition components to the fabric media (or to a previously applied layer) to evenly distribute these components to the surface of the fabric. When mixing this liquid carrier, the sodium silicate can be included with the water as a liquid and it can be readily cure into solid film under drying conditions. Thus, to the extent that it remains with the respective coating layer(s) as a solid, it can be considered to be part of the respective coating layer.

The application of the coating composition to the fabric substrate can be carried out using padding procedures generally known in the art. For example, the fabric print media can be prepared via surface treatment of the fabric substrate at three separate stations, such as would be configured for use at a padding station. The operation can be set for a single pass or multiple passes, depending on the configuration of the padding machine, either in wet-to-wet or wet-on-dry setting. In one example, the fabric substrate can be soaked in a bath and the excess can be rolled out. More specifically, impregnated fabric substrates (prepared by bath, spraying, dipping, etc.) can be passed through padding nip rolls under pressure to provide a wet picked up from 40-60%, though this range is not limiting. The coated fabric after nip rolling can then be dried under heat at any functional drying temperature and drying time.

EXAMPLES

The following examples illustrate some embodiments of the fabric print media and methods that are presently known. However, it is to be understood that the following are only exemplary or illustrative of the application of the principles of the present compositions and methods. Numerous modifications and alternative compositions and methods may be devised by those skilled in the art without departing from the spirit and scope of the present compositions and methods. The appended claims are intended to cover such modifications and arrangements. Thus, while the present recording media and methods have been described above with particularity, the following examples provide further detail in connection with what are presently deemed to be the acceptable embodiments.

Example 1—Preparation of Coated Fabric Substrates

Polyester fabric bases were used to demonstrate the coatings of the present disclosure and their effectiveness as an acceptable substrate for ink printing. Specifically, substrates of 100% woven polyester with a poplin weave structure having a weight of 197 gsm were selected for use. The three layers described herein were applied from 1 L batch coating compositions prepared using a lab mixer at room temperature according to the formulations summarized in Tables 1A-1C below. The final solution of each was adjusted by adding DI water to a solids content of 3 wt % and applied to the fabric bases as set forth in Table 2.

TABLE 1A

Primer Layer Coating Composition

| | Formulation 1A-a (parts by weight) | Formulation 1A-b (parts by weight) |
|---|---|---|
| Aflammit PE (Organophosphorus flame inhibitor) | 100 | 100 |
| Acronal NX3587 (Aqueous acrylate film-forming copolymer) | 5 | 0 |
| 2-ethylhexyl diphenyl phosphate (Fabric Softening Agent) | 2 | 2 |

TABLE 1B

Ink-fixing Layer Coating Composition

| | Formulation 1B-a (parts by weight) | Formulation 1B-b (parts by weight) |
|---|---|---|
| Aluminum Sulfate Hydrate X = 14-18 (Cationic metal complex) | | 25 |
| Poly diallyldimethylammonium chloride (cationic polymer) | 25 | |
| Aflammit PE (Organophosphorus flame inhibitor) | 10 | 10 |
| Catonic Starch (Film-forming polymer) | 0.5 | 1 |

TABLE 1C

Ink-receiving Layer Coating Composition

| | Formulation 1C (parts by weight) |
|---|---|
| Raycat 78 (Non-deformable polymer) | 100 |
| Slid Ady 300 (Non-deformable polymer) | 50 |
| Aflammit PE (Organophosphorus flame inhibitor) | 30 |
| Hauthane HD2303 (Flame inhibiting film-forming polymer) | 5 |

TABLE 2

Construction of fabric print media

| | Primer layer | Ink-fixing layer | Ink-receiving layer |
|---|---|---|---|
| Exp 1 | 1A-a | 1B-a | 1C |
| Exp 2 | 1A-a | 1B-b | 1C |
| Exp 3 (comparative) | 1A-b | 1B-b | 1C |
| Exp 4 (comparative) | Fabric Softening Agent Only | 1B-b | 1C |
| Exp 5 (comparative) | Commercial printing media | | |

Treatment on Fabric

The base fabric was impregnated using the primer compositions of Table 1A and passed through padding nip rollers with a nip pressure about 30 PSI to achieve a wet pick up from 40-60%. The impregnated substrates were then dried in a convection oven at 120° C. and then thermalset at 210° C. for 30 seconds to form the various primer layers. Next, the ink-fixing coating composition and the ink-receiving coating compositions were applied in sequence to the primer layer in the same manner, and were dried at a temperature of 120° C. The ink-receiving coating compositions were applied in sequence to the ink fixing layer in the same manner at drying at 40-50° C.

Example 2—Image Quality and Durability Testing

Once the Fabric Print Media was prepared as described above in Example 1, images were printed thereon for testing purposes. Additionally, identical image sequences were also printed on a Comparative Sample which was a commercial light textile media for digital printing. Both image sequences were printed using a HP DesignJet L25500 Printer equipped with HP 789 ink cartridges. The printer was set with a heating zone temperature at about 50° C., a cure zone temperature at about 110° C., and an air flow at about 15%. The following tests were carried out on these printed images:

Image quality—Image quality tests were conducted by measuring characteristics such as black optical density, color gamut, and ink bleed. The Black OD (KOD) and color gamut, using RGB or CMYK color patches, were measured with a spectrophotometer. The image quality of the prints related to bleed was evaluated visually from the printed samples using a scale of 1-5 (with 1 being the worst and 5 being the best).

Ink adhesion—Ink adhesion tests were carried out for dry rub resistance and resistance to damage due to folding or creasing of printed images. Specifically, rub resistance testing was carried out using an abrasion scrub tester. The fabrics were printing with small patches of all available colors (cyan, magenta, yellow, black, green, red, and blue). A weight of 900 g was loaded on the test header. The test tip was made of acrylic resin with crock cloth. The test cycle speed was 25 cm/min and 5 cycles back and forth were carried out for each sample at an 8 inch length for each cycle. The test probe can be in dry (dry rub) or wet (wet rub) mode, but for this example, dry rub was tested. The damage on the image was evaluated visually using a scale of 1-5 (with 1 being the worst and 5 being the best).

Additionally, a folding/creasing test was conducted which included first printing a test target sized 8 inches×8 inches, 100% of all colors (i.e., a composite black image). Next, the target was folded several times in both MD and CMD directions with the image size facing inwards, followed by a 5 kg/2.2 lb weight being placed on top of the folded image for 20 minutes. After 20 minutes, the target was unfolded and examined front and back for crease marks. The damage on the image was evaluated visually using a scale of 1-5 (with 1 being the worst and 5 being the best).

Water fastness—Water fastness was evaluated using three techniques: water drip, water immersion, and detergent washing. Regarding the water drip test, this was conducted by applying DI water on printed samples and observing the water damage on the image. The protocol for the water drip test was as follows: First, 3 inch×3 inch squares were printed, one square for each colorant to be tested (100% density), making sure there was 2-3 inches of white/unprinted material around each printed patch. Next, a lab eye-dropper tool was used to dispense 6-7 drops of DI water into the center of each square. This was repeated immediately for each square and then it was allowed to dry on flat table for several hours to one day. After the drying time was complete, the images were examined for permanent halos/circles forming around the printed patches. Hallowing or circles indicated flowing of additive/surface treatment agents in the material which is unfavorable.

Water immersion was carried out by immersing the printed images in water until completely soaked, and allowing the soaked images to dry.

The protocol for the detergent washing test was first to add 2 gallons of tap water (ambient temperature) into 5 gallon bucket, and then add hand washing soap (e.g., Woolite®) using recommended dosage from the soap supplier. The printed fabric sample was soaked for 5 minute, hand squeezed for 1 with medium force, and then soaked for an additional 5 minutes. Next, the soapy water was dumped out and plain tap water was added (2 gallons) and swished for 1 minute. After drying the damage on the image was evaluated visually using a scale of 1-5 (with 1 being the worst and 5 being the best).

Flame Inhibition—Fire retardancy or flame inhibition was evaluated by Diversified Test Lab Inc, complying with FR Stanford Calif. 1237. The results are summarized using scale of 1-5 (with 1 being the worst and 5 being the best).

Upon conducting these tests, the results were collected and are provided in Tables 3A and 3B below, as follows:

TABLE 3A

Test Results of Treated Fabric and Comparison

| Example | Black OD | Color gamut (rounded) | Ink bleed | Dry rub | Folding/ creasing |
|---|---|---|---|---|---|
| Exp 1 | 1.18 | 220,000 | 5 | 5 | 5 |
| Exp 2 | 1.24 | 246,000 | 5 | 5 | 5 |
| Exp 3 | 1.22 | 235,000 | 5 | 3 | 5 |
| Exp 4 | 1.18 | 218,000 | 5 | 5 | 5 |
| Exp 5 | 0.91 | 138,600 | 3 | 2 | 4 |

TABLE 3B

Test Results of Treated Fabric and Comparison

| Example | Water drip | Water immersion | Flame inhibition |
|---|---|---|---|
| Exp 1 | 5 | 5 | 4 |
| Exp 2 | 5 | 5 | 4 |
| Exp 3 | 5 | 4 | 4 |
| Exp 4 | 5 | 5 | 1 |
| Exp 5 | 1 | 1 | 1 |

As can be seen by the test results above, the surface modified fabric print media provides several advantages collectively over the comparative sample in terms of ink adhesion, image quality, waterfastness, and flame inhibition. It is noted that though some comparative media coatings performed well in some categories, they did not generally perform as well in others. In accordance with examples of the present disclosure, over all of these tests, performance was generally collectively better when using the coating layers described herein.

While the disclosure has been described with reference to certain embodiments, those skilled in the art will appreciate that various modifications, changes, omissions, and substitutions can be made without departing from the spirit of the disclosure. It is intended, therefore, that the present disclosure be limited only by the scope of the following claims.

What is claimed is:

1. A fabric print medium, comprising:

a fabric substrate;

a primer layer applied to the fabric substrate, the primer layer including a first film-forming polymer and a fabric softening agent;

an ink-fixing layer applied to the primer layer, the ink-fixing layer comprising a second film-forming polymer and a cationic compound; and an ink-receiving layer applied to the ink-fixing layer, the ink-receiving layer comprising a third film-forming polymer and non-deformable particles, wherein one or more of the primer layer, the ink-fixing layer, and the ink-receiving layer further comprise a flame inhibitor.

2. The fabric print medium of claim 1, wherein the primer layer, the ink-fixing layer, and the ink-receiving layer include the flame inhibitor.

3. The fabric print medium of claim 2, wherein the flame inhibitor is different in at least one layer compared to at least one other layer.

4. The fabric print medium of claim 1, wherein the flame inhibitor for the primer layer, the ink-fixing layer, or the ink-receiving layer is independently an organohalogenated compound, a phosphorus-containing compound, or a nitrogen-containing compound.

5. The fabric print medium of claim 1, wherein the flame inhibitor for the primer layer, the ink-fixing layer, or the ink-receiving layer is a phosphonate ester with one or two phosphorus-containing closed 4-to 6-membered ring structures.

6. The fabric print medium of claim 1, wherein the fabric substrate is woven, knitted, non-woven, or tufted, and the fabric substrate comprises natural or synthetic fibers selected from the group of wool, cotton, silk, rayon, thermoplastic aliphatic polymers, polyesters, polyamides, polyimides, polypropelene, polyethylene, polystyrene, polytetrafluoroethylene, fiberglass, polytrimethylene, polycarbonates, polyester terephthalate, or polybutylene terephthalate.

7. The fabric print medium of claim 1, wherein the third film-forming polymer in the ink-receiving layer is a flame inhibiting film-forming polymer.

8. The fabric print medium of claim 1, wherein the fabric softening agent is selected from the group of imidazolium; quaternary alkoxy ammonium salts; quaternary ammonium salts with one or two $C_8$ to $C_{35}$ alkyl chains; quaternary salts with one or two $C_8$ to $C_{35}$ alkyl side chains; organophspheric esters from phosphates, phosphonates, or phoshpinates; and mixtures thereof.

9. The fabric print medium of claim 1, wherein cationic compound is a cationic metal complex.

10. The fabric print medium of claim 1, wherein the cationic compound is a cationic polymer.

11. The fabric print medium of claim 1, wherein the non-deformable particles are i) prepared from hydrophobic addition monomers selected from the group of $C_1$-$C_{12}$ alkyl acrylate and methacrylate monomers, aromatic monomers, hydroxyl containing monomers, carboxylic acid containing monomers, vinyl ester monomers, vinyl benzene monomers, $C_1$-$C_{12}$ alkyl acrylamide and methacrylamide monomers, olefin monomers, and combinations thereof; or ii) selected from the group of polytetrafluoroethylene (PTFE), silica, silicone, paraffin wax, carnauba wax, montan wax, and combinations thereof.

12. The fabric print medium of claim 1, wherein the fabric substrate has two sides, and both of the two sides are coated with the primer layer, the ink-fixing layer, and the ink-receiving layer.

13. A method of coating a fabric substrate to form a fabric media substrate, comprising:

impregnating a fabric substrate with a primer coating composition to form a primer layer, the primer coating composition including a first film-forming polymer and a fabric softening agent;

applying an ink-fixing layer coating composition onto the primer layer form an ink-fixing layer, the ink-fixing layer coating composition including a second film-forming polymer and a cationic compound; and applying an ink-receiving layer coating composition onto the ink-fixing layer to form an outermost ink-receiving layer, the ink-receiving layer coating composition including a third film-forming polymer and non-deformable particles, wherein one or more of the primer layer coating composition, the ink-fixing layer coating composition, and the ink-receiving layer coating composition further comprises a flame inhibitor.

14. The method of claim 13, further comprising the step of calendaring the primer layer, the ink-fixing layer, the ink-receiving layer, or any combination thereof.

15. The method of claim 13, further comprising the steps of drying the primer layer under heat at temperature greater than 120° C., and drying one or both of the ink-fixing layer and the ink-receiving layer under heat at a temperature less than 100° C.

16. The fabric print medium of claim 1, wherein the non-deformable particles are prepared from hydrophobic addition monomers selected from the group of $C_1$-$C_{12}$ alkyl acrylate and methacrylate monomers, aromatic monomers, hydroxyl containing monomers, carboxylic acid containing monomers, vinyl ester monomers, vinyl benzene monomers, $C_1$-$C_{12}$ alkyl acrylamide and methacrylamide monomers, olefin monomers, and combinations thereof.

17. The method of claim 13, wherein the non-deformable particles are prepared from hydrophobic addition monomers selected from the group of $C_1$-$C_{12}$ alkyl acrylate and methacrylate monomers, aromatic monomers, hydroxyl containing monomers, carboxylic acid containing monomers, vinyl ester monomers, vinyl benzene monomers, $C_1$-$C_{12}$ alkyl acrylamide and methacrylamide monomers, olefin monomers, and combinations thereof.

18. The fabric print medium of claim 1, wherein the non-deformable particles are non-deformable during manufacturing of the coating composition and storing of the fabric print medium, but can deform or form a film due to a rise in temperature during a cure process of printing.

19. The fabric print medium of claim 1, wherein the non-deformable particles are capable of cross-linking upon exposure to heat during printing.

20. The fabric print medium of claim 1, wherein the fabric softening agent is selected from the group of quaternary alkoxy ammonium salts; quaternary ammonium salts with one or two $C_8$ to $C_{35}$ alkyl chains; quaternary salts with one or two $C_8$ to $C_{35}$ alkyl side chains; organophospheric esters from phosphates, phosphonates, or phosphinates; and mixtures thereof.

* * * * *